United States Patent [19]

Aono

[11] Patent Number: 4,978,020

[45] Date of Patent: Dec. 18, 1990

[54] FOLDABLE BOX

[76] Inventor: Yukihiko Aono, No. 1328-3, Sodecho, Hamamatsu-shi, Shizuoka-ken, Japan

[21] Appl. No.: 216,215

[22] Filed: Jul. 7, 1988

[30] Foreign Application Priority Data

Jul. 10, 1987 [JP] Japan ..... 62-173401
Jul. 21, 1987 [JP] Japan ..... 62-111451[U]
Mar. 11, 1988 [JP] Japan ..... 63-32927[U]

[51] Int. Cl.[5] ..... B65D 11/18

[52] U.S. Cl. ..... 220/7; 206/509; 206/512; 229/190

[58] Field of Search ..... 220/1.5, 4 C, 4 F, 6, 220/7; 206/509, 511, 512; 229/190

[56] References Cited

U.S. PATENT DOCUMENTS

| | | | |
|---|---|---|---|
| 1,451,468 | 4/1923 | Olshan | 220/6 |
| 3,446,415 | 5/1969 | Bromley | 220/7 |
| 3,516,592 | 6/1970 | Friedrich | 220/7 |
| 3,521,811 | 7/1970 | DePaul et al. | 229/190 |
| 3,675,808 | 7/1972 | Brink | 220/7 |
| 3,874,546 | 4/1975 | Sanders et al. | 220/7 |
| 3,900,157 | 8/1975 | Roth | 220/7 |
| 3,973,692 | 8/1976 | Cloyd | 220/7 |
| 4,170,313 | 10/1979 | Caves et al. | 220/7 |
| 4,304,353 | 12/1981 | Stollberg | 229/190 |
| 4,591,065 | 5/1986 | Foy | 220/7 |
| 4,674,647 | 6/1987 | Gyenge et al. | 220/6 |
| 4,693,386 | 9/1987 | Hughes et al. | 220/7 |

FOREIGN PATENT DOCUMENTS

| | | | |
|---|---|---|---|
| 1301753 | 8/1969 | Fed. Rep. of Germany | 220/6 |

*Primary Examiner*—George L. Walton
*Attorney, Agent, or Firm*—Wegner, Cantor, Mueller & Player

[57] ABSTRACT

In a foldable box including a bottom plate integrally and bendably connected to side plates, both formed of a flexible material, the adjacent side plates are divided along their opposing side edges, one of said adjacent side plates being integrally and bendably connected at its opposing side edge with a gore plate formed of the same material, and a guide groove for slidably receiving said gore plate being formed in a wall of an opposing edge of said other side plate. Further, one of said gore plate and said wall of said opposing edge of said other side wall is provided with an associated hole therethrough in the thickness-wise direction, and the other is integrally provided with an engaging piece which is formed of the same material and is bendable in the thickness-wise direction. Said engaging piece is fitted in said associated hole, when said gore plate is fitted into the deepest position of said guide groove.

10 Claims, 9 Drawing Sheets

FOLDABLE BOX

BACKGROUND OF THE INVENTION

1. Field of the Invnetion

The present invention relates to a foldable box and, more particularly, to a foldable box formed of a flexbile material such as plastics, cloth and paper.

2. Description of the Prior Art

Some foldable boxes heretofore in use are of the structure that a bottom plate is formed of a plastic material, side plates formed of the same material are integrally and bendably connected to the edges of the bottom plate, the adjacent side plates are divided along the opposing edges, and a disengageable connector fitting is attached to such opposing edges.

Thus, the conventional foldable boxes have been disadvantagous in that due to the structure that a connector fitting is attached to the opposing edges of the adjacent side plates as a separate part, such a connector fitting is so laborious to attach that their assembling or unfolding operations are troublesome.

There has been another disadvantage that when placed one upon another, a number of foldable boxes may collapse due to an unexpected external force.

SUMMARY OF THE INVENTION

An object of the present invention is to obtain a novel foldable box free from such disadvantages as mentioned above.

Another object of the present invention is to obtain a novel foldable box including side plates, the bends of which are reinforced with respect to a load acting thereon from the sideward.

A still further object of the present invention is to obtain novel foldable boxes which are easily placed one upon another and, when stacked up, are prevented from collapsing.

In order to attain such objects as stated above, the box of the present invention is of the following structure.

A bottom plate and side plates, both formed of a flexible material, are connected with each other in an integral and bendable manner. The adjacent side plates are divided along their opposing side edges, one of said adjacent side plates being integrally and bendably connected at its opposing side edge with a gore plate formed of the same material, and a guide groove for slidably receiving said gore plate being formed in a wall of an opposing edge of said other side plate. One of said gore plate and said wall of said opposing edge of said other side wall is provided with an engaging hole therethrough in the thickness-wise direction, and the other is integrally provided with an engaging piece which is formed of the same material and is bendable in the thickness-wise direction. Said engaging piece is designed to be fitted in said engaging hole, when said gore plate is fitted into the deepest position of said guide groove.

According to the foldable box of the present invention as constructed above, as the side plates are bent perpendicularly (upwardly) with respect to the bottom plate with the gore plates fitted into the guide grooves, the engaging pieces are fitted and locked into the the associated holes at the time when the gore plates are fitted into the deepest positions of the guide grooves, i.e., the opposing edges of the adjacent side plates are close to each other, whereby the adjacent side plates are connected to each other and remain bent perpendicularly with respect to the bottom plate.

In this state, when the engaging pieces are bent in the thickness-wise direction, they are disengaged from within the associated holes to disconnect the adjacent side plates.

In order to reinforce the bends of the side plates with respect to a load acting thereon from above, the box of the present invention is of the following structure.

The side plates are provided with longitudinal ribs projecting in the thickness-wise direction thereof and extending vertically. The lower ends of said longitudinal ribes extend below the connecting portions of said bottom plate with said side plates, and the lower end faces of said longitudinal ribs are substantially flush with the lower face of the bottom plate, and end edge faces of the bottom plate corresponding to said lower ends of the longitudinal ribs are provided with recesses into or from which said lower ends can be fitted or disengaged.

According to the box as constructed above, when the side plates are bent perpendicularly (upwardly) with respect to the bottom plate, the lower ends of the longitudinal ribs are disengaged from the recesses formed in the bottom plate, and their lower faces are brought into contact with the ground, whereby a load applied on the side plates from above is borne by said longitudinal ribs.

When the side plates are turned outwardly with respect to the bottom plate, the lower ends of the longitudinal ribs are turned toward the bottom plate around the connecting portions of the bottom plate with the side plates, and are then fitted into the recesses in said bottom plate, whereby the side plates are horizontally expanded in a similar manner to that of the bottom plate.

In order to reinforce the bends of the side plates with respect to a sideward load acting thereon, the box of the present invention is of the following structure.

One side plate connected with the gore plate is provided with a hook-like lock means projecting toward the opposing edge of the other side plate, said lock means being engaged with the other side plate from the direction normal to the direction of turning thereof.

According to the foldable box of the present invention as constructed above, as the side plates are bent perpendicularly (upwardly) with resepct to the bottom plate with the gore plates fitted into the guide grooves, the engaging pieces are fitted and locked into the the associated holes at the time when the gore plates are fitted into the deepest positions of the guide grooves, i.e., the opposing edges of the adjacent side plates are close to each other. At the same time, the lock means provided on one side plate is engaged with the other side plate from the direction normal to the direction of turning thereof.

Thus, the adjacent side plates remain bent perpendicularly with respect to the bottom plate, and are connected and held with each other by the portion of the gore plate and the lock means.

In this state, when the engaging pieces are bent in the thickness-wise direction, the engaging pieces and the locking means are respectively disengaged from within the associated holes and from the other side to disconnect the adjacent side plates.

In order to prevent a stack of foldable boxes from collapsing, each box is provided with projecting pieces on upper portions of its four corners and with recesses in lower portions of its four corners, said projecting pieces being designed to be fitted into said recesses when a plurality of boxes are put one upon another.

DESCRIPTION OF THE PREFERRED EMBODIMENTS

The present invention will now be explained with reference to the drawings.

Figure 1:
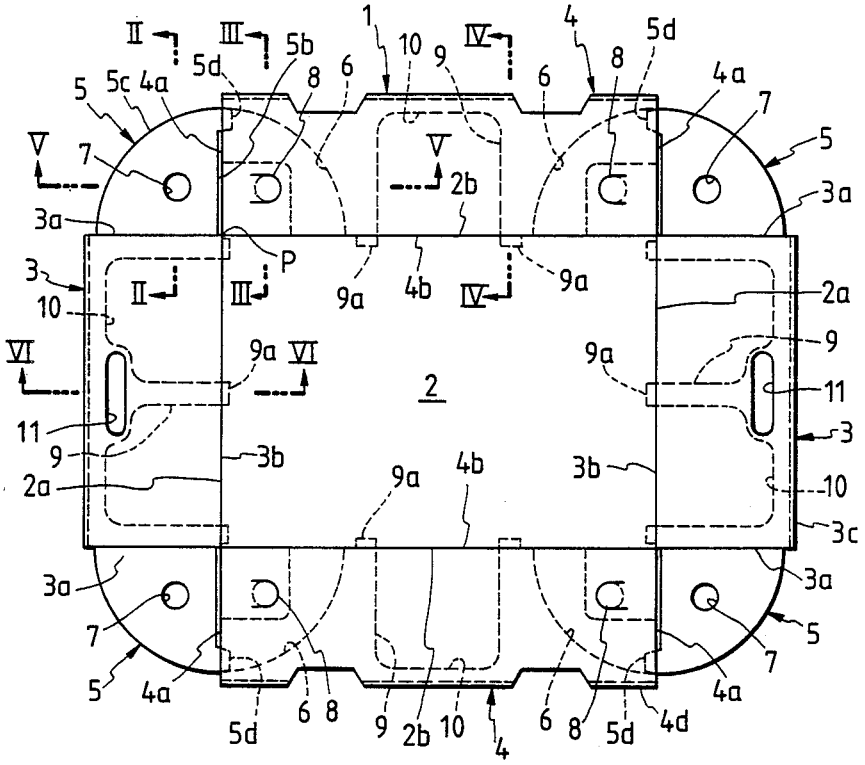
FIG. 1 is a plan view of a box according to one embodiment of the present invention, which is shown in an unfolded state.
Figure 5:
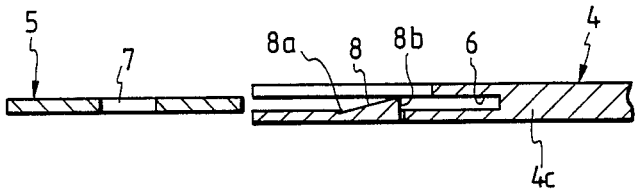
Figure 6:
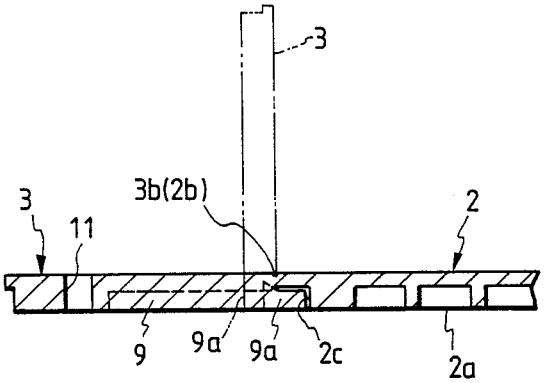
Figure 7:
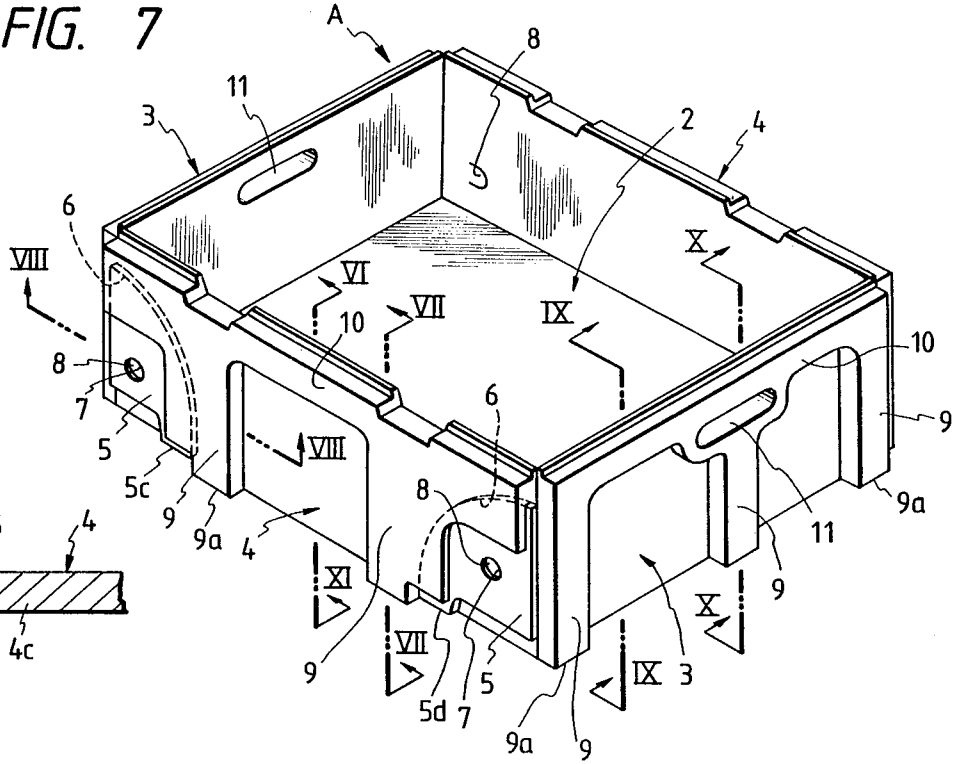
FIG. 7 is a perspective view of the assembled box.
Figure 8:
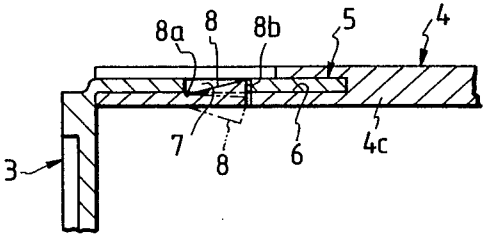
FIG. 8 is a sectional view taken along the line VIII—VIII of FIG. 7.

In the drawings, FIG. 1 is a plan view of a box according to one embodiment of the present invention, which is shown in an unfolded state, FIGS. 2 to 6 are sectional views taken along the lines II—II to VI—VI of FIG. 1, FIG. 7 is a perspective view of the box in an assembled state, and FIG. 8 is a sectional view taken along the VIII—VIII of FIG. 7.

Referring now to FIG. 1, a foldable box generally shown at 1 is molded of an elastic, hard plastic material such as polypropylene, and includes a bottom plate 2 in the rectangular form and side plates 3.3 and 4.4 in the rectangular form as integral pieces being at the edges of the plate 2, i.e., short sides 2*a* and long sides 2*b*.

The side plates 3.3 on the short sides 2*a* and the side plates 4.4 on the long sides 2*b* being of the same structure, the left and upper plates will typically be explained.

Figure 3:
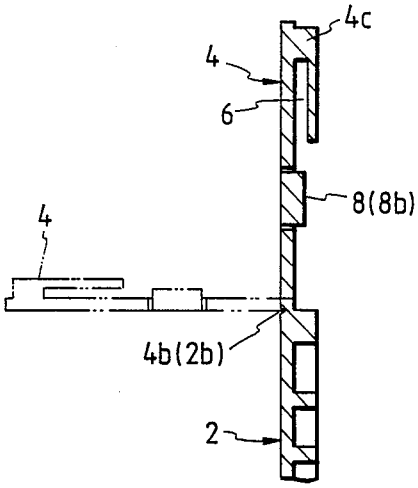
Figure 4:
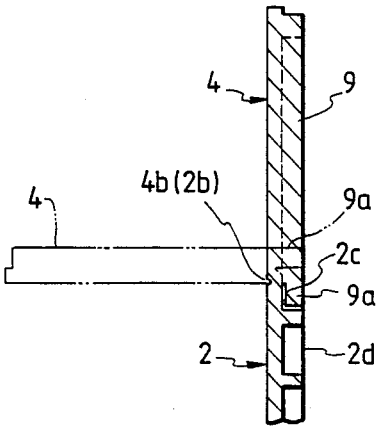

As illustrated in more detail in FIGS. 3, 4 and 6, connecting edges 3*b* and 4*b* of the side plates 3 and 4 with the bottom plate 2 are so shaped as to decrease their thickness and hence their bending rigidity, whereby the side plates 3 and 4 are bendable in the directions normal (upward) and horizontal with respect to the bottom plate 2.

Figure 2:
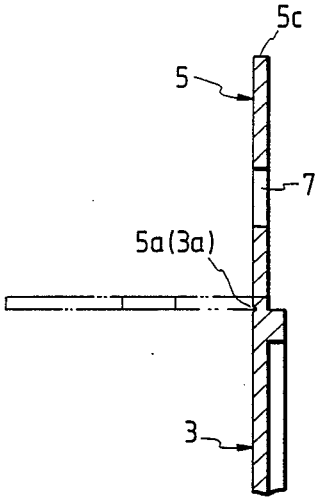
FIGS. 2 to 6 are sectional views taken along the lines II—II to VI—VI of FIG. 1.

The side plates 3 and 4 are divided along their opposing edges 3*a* and 4*a*, and the edge 3*a* of the side plate 3 on the short side 2*a* is integrally connected with a gore plate 5 in the form of a fan as viewed on a plane, as illustrated in FIG. 1. The gore plate 5 is formed of the same material as the side plate 3, and is molded simultaneously with the molding of the side plate 3. As illustrated in FIG. 2, a connecting portion of the edge 3*a* of the side plate 3 with an end edge 5*a* of the gore plate 5 is so shaped as to decrease its thickness and hence its bending rigidity, whereby it is bendable in the direction normal (inward) to the side plate 3 and in the extending direction of the side plate 3.

The gore plate 5 includes a peripheral edge 5*c* in the form of a circular arc having a radius slightly smaller than the height-wise width of the side plates 3 and 4 around a point P on a corner portion of the bottom plate 2, and is regulated to an opening angle of about 90° . The gore plate 5 is allowed to approach at its open end edge 5*b* the opposing edge 4*a* of the side plate 4 on the long side 2*b* during expansion, and is provided on the outer periphery of its open end edge 5*b* with an outwardly projecting fitting claw 5*d* which, as will be described later, is constantly engaged within a guide groove 6 formed in the side plate 4 (see FIG. 3).

The opposing edge 4*a* of the side plate 4 on the long side 2*b* is provided with the guide groove 6 which is slidably engaged over the outer periphery of the gore plate 5.

As illustrated in FIGS. 1 and 3, the side plate 4 is provided with a reinforcing thicker 4*c* which is in the form of a hook extending from the outer periphery of the opposing edge 4*a* toward the connecting edge 4*b*. The guide groove 6 in the form of a circular arc around the aforesaid point P is formed in that thicker portion 4*c*.

The radius and width of the guide groove 6 are slightly larger than those of the gore plate 5.

As illustrated in FIG. 1, the fitting claw 5*d* of the gore plate 5 as mentioned above then projects outwardly to such an extent that it does not disengage from within the guide groove 6 in an unfolded state.

The gore plate 5 is also provided through its substantially central portion with a circular associated hole 7, which is in engagement with an semi-circular engaging piece 8 formed inside of the guide groove 6 in the side plate 4.

As shown in FIG. 5, the engaging piece 8 as mentioned just above is thinned on the opposing edge 4*a* of the side plate 4, i.e., as shown at 8*a*, and is integrally and bendably connected to the side plate 4, while its open end 8*b* is separated from the side plate 4 through an arched slit. Further, the engaging piece 8 increases in thickness from the portion 8*a* toward the open end 8*b*, and an outer end of the open end 8*b*, as viewed in the thickness-wise direction, projects from an outer face of the side plate 4 outwardly, as viewed in the thickness-wise direction.

As again in FIG. 1, the associated hole 7 and engaging piece 8 as mentioned above are linearly symmetrical with respect to the opposing edge 4*a* of the side plate 4 and spaced equally away from the point P at angles of 45°. Further, the open end 8*b* of the engaging piece 8 has a radius slightly smaller than that of the associated hole 7.

Thus, when the gore plate 5 is fitted into the deepest position of the guide groove 6, the associated hole 7 is fitted over the engaging piece 8 for their engagement.

The side plates 3 and 4 are provided as integral pieces with reinforcing longitudinal and lateral ribs 9 and 10 which are locally increased in thickness.

As illustrated in FIG. 1, the lateral ribs 10 extend along the outer peripheries 3*c* and 4*d* of the side plates 3 and 4.

The longitudinal ribs 9 are provided at the predetermined intervals in the longitudinal direction of the side plates 3 and 4, and extend from the outer peripheries 3*c* and 4*d* thereof toward the connecting edges 3*b* with the lower ends 9*a* projecting from the connecting edges 4*b* of the side plates 3 and 4 toward the bottom plate 2, as illustrated in FIGS. 1, 4 and 6.

An escape recess 2*c*, into which each lower end 9*a* is to be fitted, is formed in the lower face of the edge of the bottom plate 2 facing said lower end 9*a*.

The lower faces of the lower ends 9*b* of the longitudinal ribs 9 as stated above are such that when the side plates 3 and 4 are uprighted, they are flush with the lower face 2*b* of the bottom plate 2, as shown by phantom lines in FIGS. 4 and 6. It is to be noted that reference numeral 11 stands for a handle hole.

Figure 9:
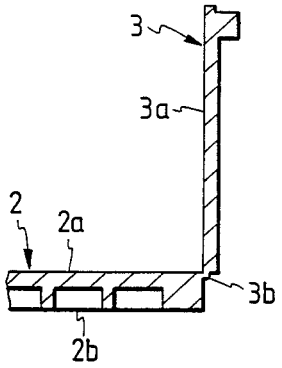
FIGS. 9 to 12 are sectional views taken along the lines IX—IX to XII—XII of FIG. 7.
Figure 11:
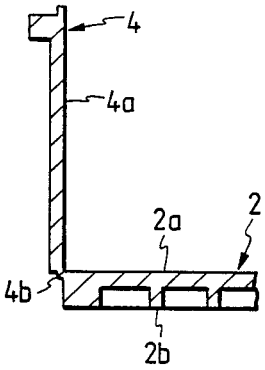

As illustrated in FIGS. 9 and 11, when the side plates 3 and 4 are bent upwardly with respect to the bottom plate 2, the connecting edges 3*b* and 4*b* thereof are located above the lower face 2*b* of the bottom plate 2, i.e., the ground.

For that reason, when a load is applied to the side plates 3 and 4 from above, as experienced in the event that a number of boxes are put one upon another by way of example, a certain load is applied to the connecting edges 3*b* and 4*b* of a reduced thickness, thus offering a disadvantage that they may be damaged.

To eliminate such a disadvantage, the recesses 2*c* are formed in the lower face of the edge of the bottom plate 2 facing the lower ends 9*a* of the longitudinal ribs 9, as already stated and shown in FIGS. 4, 6, 10 and 12. As illustrated in FIGS. 4 and 6, the recesses 2*c* are of such a shape that when the side plates 3 and 4 are turned horizontally, the lower ends 9*a* of the longitudinal ribs 9 are fitted therein. It is appreciated that such recesses 2*c* may extend vertically through the edges of the bottom plate 2.

Figure 10:
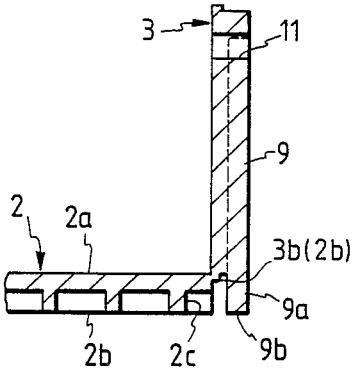
Figure 12:
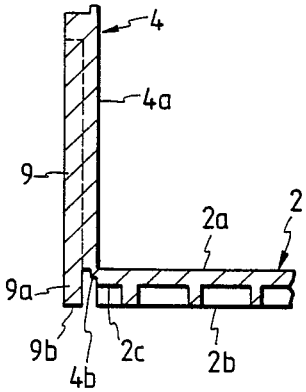

When the side plates 3 and 4 are uprighted perpendicularly with respect to the bottom plate, the lower end faces 9*b* of the longitudinal ribs 9 are positioned on a line extending from the lower face 2*b* of the bottom plate 2, as illustrated in FIGS. 10 and 12.

Reference will now be made to how to use the embodiment as described above.

The side plates 3 and 4, now shown in FIG. 1, are bent upwardly from the connecting edges 3*b* and 4*b*. As the angle of said bending increases, the gore plates 5 are deeply fitted into the guide grooves 6. At the time when the side plates 3 and 4 are uprighted perpendicularly (upwardly) with respect to the bottom plate 2, the gore plates 5 are fitted into the deepest positions of the guide grooves 6, and the opposing edges 3*a* and 4*a* of the adjacent side plates 3 and 4 are close to each other.

As the gore plates 5 are fitted into the guide grooves 6, their open ends edge 5*b* force and bend inwardly the engaging pieces 8 and, at the same time, the associated holes 7 approach the engaging pieces 8. Upon the gore plates 5 being fitted into the deepest positions of the guide grooves 6, the associated holes 7 are fitted over the engaging pieces 8, and the engaging pieces 8 are resiliently restored and fitted and locked in the associated holes 7.

Thus, the adjacent side plates 3 and 4 remain bent perpendicularly with respect to the bottom plate 2, as shown in FIG. 7, whereby a box A of a rectangular parallelepiped, open on its upper face, is defined. The box A may accommodate parts, etc.

In this case, the engagement of the associated hole 7 with the engaging piece 8 is achieved with a pressure acting upon the end faces of both, i.e., a force acting in the direction normal to the bending direction of the engaging piece 8, and the gore plate 5 is integrally connected to the opposing edge 3*a* of the side plate 3 along its substantial length, whereby the strength of connection of the adjacent side plates 3 and 4 is increased.

Thus, it is possible to prevent the side plates 3 and 4 from being inadvertantly unfolded by an outward load due to contents.

In assembling, since the lower ends 9*a* of the longitudinal ribs 9 are flush with the lower face 2*d* of the bottom plate 2, a vertically acting load is mainly borne by the longitudinal ribs 9.

Next, in order to expand (unfold) the box A into a flat state, a push is given from outside to the engaging piece 8 to bend it inwardly through the given angle, as shown by a phantom line in FIG. 8. The engaging piece 8 is then disengaged from within the associated hole 7 in the gore plate 5, so that the gore plate 5 is slidable along the guide groove 6.

In this state, if the side plates 3 and 4 are turned outwardly with respect to the bottom plate 2, the whole arrangement is made flat, as shown in FIG. 1, so that the space allowed for transportation or storage is saved.

In the present invention, it is appreciated that the side plates 3 and 4 and the bottom plate may be formed of the same material with the aid of different molds, and that one connecting portion may be provided with a hook, while the other may be provided with a shaft to be rotatably engaged with said hook, said hook being designed to be fitted and engaged under pressure into said shaft.

It is also appreciated that a stiffening plate such as a metal or ceramic plate may be fixed onto a face of the engaging piece 8 to be in engagement with the associated hole 7 to improve the wear resistance of said face.

In the present invention, it is further appreciated that the associated hole 7 may be formed in the side plate 4, and the engaging piece 8 may be formed on the gore plate 5. In this case, however, it is required that the engaging piece 8 is such that its portion 8*a* is located on the side of the open edge 5*b* of the gore plate 5, while its open end 8*b* is positioned on the side of the portion 5*a* of the gore plate 5.

In the embodiment as described and illustrated above, during assembling, the connection of the opposing edges of the adjacent side plates 3*a* and 4*a* is achieved by the connecting portion 3*a* of the gore plate 5, which is of a reduced thickness. In some cases, therefore, the connecting portion 3*a* may be cracked by an outward load generated when a heavy article is accommodated in the box.

According to the present invention, that problem is solved by such a specific embodiment as described and illustrated hereafter.

Figure 13:
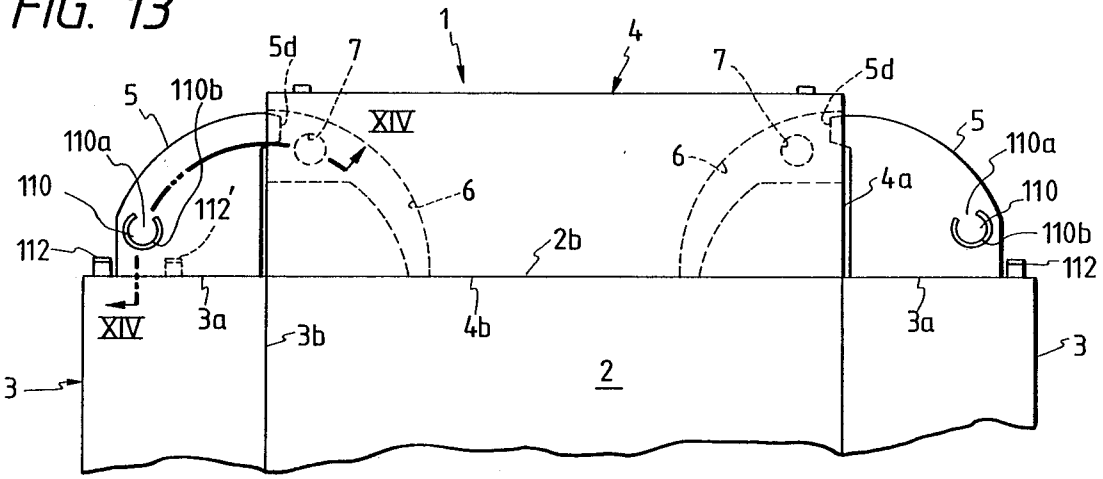
FIG. 13 is a partial plan view of a box according to another embodiment of the present invention, which is shown in an unfolded state.
Figure 14:
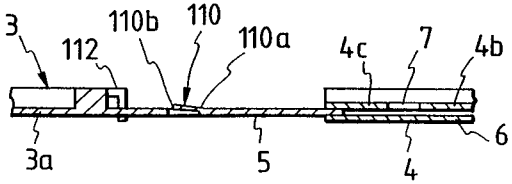
FIG. 14 is a sectional view taken along the line XIV—XIV of FIG. 13.
Figure 15:
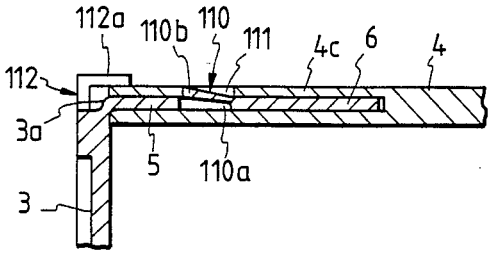
FIG. 15 is a sectional view correponding to FIG. 14, in which the box is shown in an assembled state.
Figure 16:
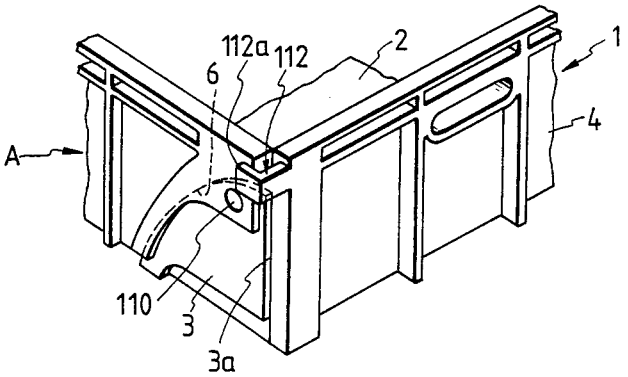
FIG. 16 is a perspective view corresponding to FIG. 15, in which the box is shown in an assembled state.
Figure 17:
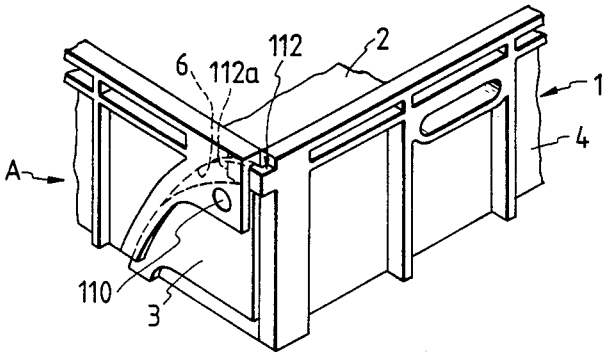
FIG. 17 is a perspective view of a box according to still another embodiment of the present invention.

In the drawings, FIG. 13 is a partial plan view of a foldable box according to another embodiment of the present invention, which is in an unfolded state, FIG. 14 is a sectional view taken along the line II—II of FIG. 13, FIG. 15 is a sectional view of the assembled box, FIG. 16 is a perspective view of the assembled box, and FIG. 17 is a perspective view showing a further embodiment of the present invention.

It is noted that throughout FIGS. 13 to 16, parts of similar structures as illustrated in FIG. 1 are shown by like reference numerals, and an explanation thereof is thus omitted.

A gore plate 5 includes a connecting portion 3*a* which is provided on its outer periphery with an engaging protrusion 110 in the form of a semi-disk, said protrusion being opened with respect to the connecting portion 3*a* by the provision of an arched slit.

The engaging protrusion 110 includes a portion 110*a* of a reduced thickness, and is connected to the gore plate 5 in such a way that it is bendable in the thickness-wise direction. The engaging protrusion 110 increases in thickness from the portion 110*a* toward an open end 110*b* and, as illustrated in FIG. 14, an outer extremity of the open end 110*b*, as viewed in the thickness-wise direction, projects from an outer face of the gore plate 5 outwardly as viewed in the thickness-wise direction.

As illustrated in FIG. 15, an outer wall 4*c* forming a guide groove 6 in the other side plate 4 is provided with a circular associated hole 7 which receives the engaging protrusion 110, when the gore plate 5 is fitted into the deepest position of the guide groove 6.

One side plate 3 is integrally provided with a projecting lock means 112 which is to be positioned at an outer end of the connecting portion 3*a* of the gore plate 5.

The lock means 112 is hooked at its extreme end 112*a*, and is such that when the gore plate 5 is fitted into the deepest position of the guide groove 6, the opposing edge of the other side plate 4 is fitted into that extreme end 112*a*, as illustrated in FIG. 16.

It is noted that as illustrated by a phantom line in FIG. 13, one or plural of lock means 112' similar to the lock means 112 may be provided on the connecting portion 3*a* of the gore plate 5.

It is also noted that, as illustrated in FIG. 17, a guide groove 6' may extend above the gore plate 5 so as to receive in its upper portion the extreme end 112*a* of the lock means 112.

Reference will now be made to how to use the foregoing embodiment.

The side plates 3 and 4, now illustrated in FIG. 13, are bent upwardly from the connecting edges 3*b* and 4*b*. As the angle of bending increases, the gore plate 5 is deeply fitted into the guide groove 6. At the time when the side plate 3 and 4 are uprighted perpendicularly (upwardly) to the bottom plate 2, the gore plate 5 is fitted into the deepest position of the guide groove 5, whereby the opposing edges of the adjacent side plates 3 and 4 are close to each other.

In this case, as the gore plate 5 is fitted into the guide groove 6, the engaging protrusion 110 is forced inwardly and deformed by the outer wall 4*c* of the guide groove. When the gore plate 5 is fitted into the deepest position of the guide groove 6 to allow the engaging protrusion 110 to face the associated hole 7, the engaging protrusion 110 is resiliently restored and fitted and locked in the associated hole 7.

At the same time, the lock means 112 is caused to engage one side plate 3 from the outward direction normal to the direction of turning thereof.

Thus, the adjacent side plates 3 and 4 remain bent in the direction normal to each other by the connecting portion 3*a* of the gore plate 5 and the lock means 112, whereby an assembled box (A) of a rectangular parallelepiped, open on its upper face, if formed, as shown in FIG. 16. The box (A) may accommodate parts, etc.

In this case, the gore plate 5 mainly functions to prevent further expansion of one side plate 4, and the lock means 112 mainly serves to prevent further expansion of the other side plate 3, so that the strength of connection of the adjacent side plates 3 and 4 is increased.

Next, in order to unfold (expand) the thus assembled box (A) into a flat state, an inward push is given from the outside to the engaging protrusion 110 to disengage it from within the associated hole 7. In this case, if the side plates 3 and 4 are turned outwardly with respect to the bottom plate 2, then the whole arrangement is made flat, as shown in FIG. 13, so that the space allowed for transportation or storage is reduced.

In the present invention, it is understood that the side plates 3 and 4 and the bottom plate 2 may be formed of the same material using different molds, and that one connecting portion may be provided with a hook, while the other may be provided with an engaging shaft with which said hook is turnably engaged, said hook being designed to be fitted and engaged under pressure into said engaging shaft.

Figure 18:
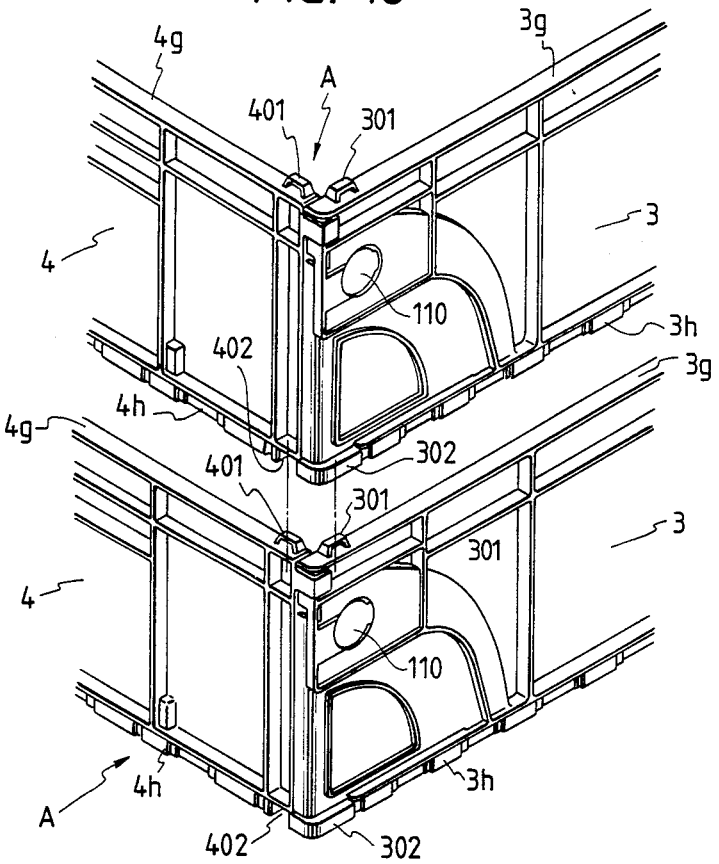
FIG. 18 is a perspective view of a box according to a further embodiment of the present invention, which illustrates a mechanism for preventing a number of boxes put one upon another from collapsing.
Figure 19:
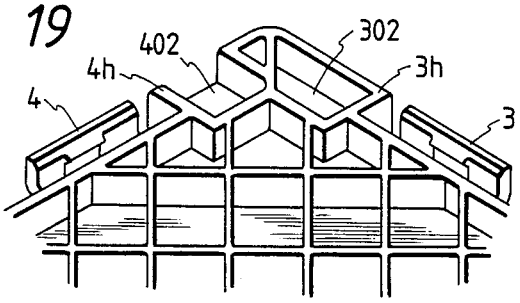
FIG. 19 is a bottom view of FIG. 18.

A mechanism for preventing a number of foldable boxes A placed one upon another from collapsing will now be explained with reference to FIGS. 18 and 19.

Projecting pieces 301 and 401 are respectively formed on upper edges 3*g* and 4*g* of the four corners of said plates 3 and 4 of a box A, and recesses 302 and 402 are provided in lower edges 3*h* and 4*h* of the four corners. The recesses 302 and 402 of an upper box A are respectively fitted onto the projecting pieces 301 and 401 of a lower box A.

With such an arrangement, the four corners of the upper and lower boxes are in alignment so complete that they are unlikely to collapse easily even upon receiving a sideward external force.

Further, the outer wall of the recesses 402 is removed and kept open, so that when it is intended to open only a desired box of a stack of boxes, the box just above that box is pulled out, while giving a push to the engaging protruction 110 thereof, whereby that box is opened. Thus, that box can be charged or emptied freely.

Figure 20:
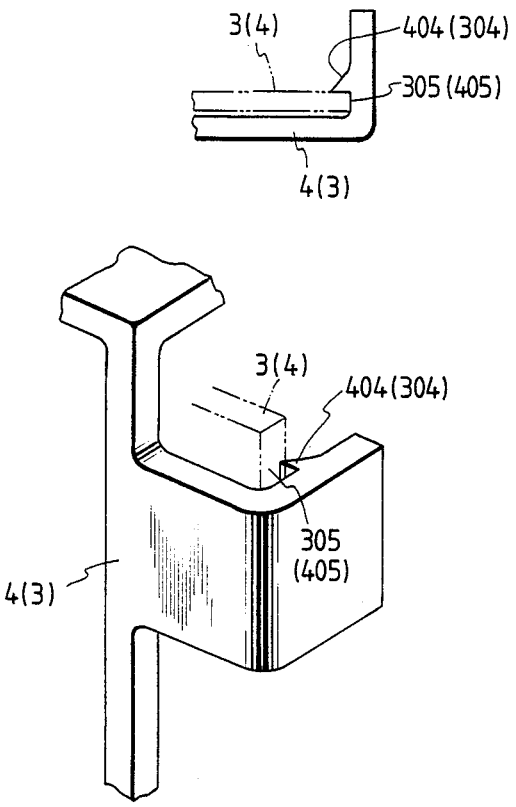
FIG. 20 is a view illustrative of the lock means of four corners.

In order to completely join the extreme ends 305 or 405 of the side plates 3 and 4 to each other at the four corners of a box, it is preferred that locking protrusions 304 or 404 are formed on the portions of the side plates 3 and 4 which are joined to each other as shown in FIG. 20. When assembling a box, the extreme ends 305 or 405 ride over the protrusions 304 or 404 and reach the normal joining positions where they are stopped. Thereafter, they are pressed down by the protrusions 304 or 404 and retained in place.

As will be clearly appreciated from the foregoing explanation, the present invention makes effective use of the functions of a flexible material, while reducing the use of other materilas as much as possible, and thus offers advantages such as improvements in productivity, rapid assembling and unfolding operations, increases in the rigidity of assembled boxes, and so on.

It is also possible to obtain further advantages such as increases in rigidity with respect to vertically acting loads and savings in the space allowed for transportation or storage due to the fact that the side plates can be horizontally unfolded as is the case with the bottom plate, since the lower ends of the longitudinal ribs formed in each side plate are allowed to extend below the connecting edges of each side plate with the bottom plate, and the end edges of the bottom plate corresponding to the lower ends of such ribs are provided with the recesses into or from which said lower ends can be fitted or disengaged.

I claim:

1. A foldable box comprising:

an essentially rectangular bottom plate formed of a flexible material;

four essentially rectangular side plates each integrally and bendably connected to the bottom plate, said side plates formed of a flexible material, wherein each two adjacent side plates includes means for detachably connecting each other;

said means for detachably connecting comprising:

four gore plates, each of said gore plates integrally and bendably connected to a side edge of the side plates;

four corresponding guide grooves, each of said guide grooves for slidingly engaging one of said gore plates, each of said guide grooves being on the edge of an adjacent side plate opposing one of said gore plates, each of said guide grooves being formed within a wall portion of the side plates near its opposing side edge between an inner surface and an outer surface of said wall portion;

an engaging piece associated with each gore plate and its corresponding guide groove, each of said engaging pieces projecting from a surface of one of said gore plate and said wall portion of the side plate having the corresponding guide groove near its opposing side edge, each of said engaging pieces being bendable towards said surface; and an associated hole for engaging each of said engaging pieces when the gore plate is fully received into its corresponding guide groove, each of said associated holes formed in the surface of the other of said gore plate and said wall portion of the side plate having the corresponding guide groove .

2. The foldable box according to claim 1, wherein two opposed side plates each include a gore plate at both side edges and two other opposed side plates each include a guide groove near both side edges.

3. The foldable box according to claim 1, wherein each of said gore plates is provided with said associated hole.

4. The foldable box according to claim 1, wherein each of said wall portions of the side plates having the corresponding guide groove is provided with said associated hole.

5. The foldable box according to claim 1, wherein an outer periphery of each of said gore plates is arcuate, and the guide grooves have a corresponding arcuate shape for slidably receiving the outer periphery of said gore plates.

6. The foldable box according to claim 1 wherein each of said side plates is provided with longitudinal ribs projecting from an outer surface thereof and extending vertically, the lower ends of said longitudinal ribs extending below a connecting edge of said bottom plate between the bottom plate and a side plate such that a lower end face of said longitudinal ribs is substantially flush with a lower face of the bottom plate when the foldable box is in an assembled state, and an end edge face of said bottom plate includes recesses for engaging said lower ends of the longitudinal ribs when the foldable box is in a nonassembled state.

7. The foldable box according to claim 1, wherein each side edge of said side plates connected to one of said gore plates is provided with a hook-like lock means for engaging an opposing edge of an adjacent side plate in a direction normal to a direction of bending the adjacent side plate, said hook-like lock means projecting toward the opposing side edge of said adjacent side plate.

8. The foldable box according to claim 1, further including projecting pieces on upper portions of its side plates near each corner, and corresponding recesses in bottom portions of its side plates near each corner for engaging the projecting pieces of a second foldable box placed thereon.

9. The foldable box according to claim 1, further including locking protrusions on the opposing edge of a side plate for lockingly engaging an extreme end of an adjacent side plate.

10. A blank foldable to form a box having a bottom plate and four side plates, said blank comprising:

(A) an essentially planar rectangular bottom panel having two sides and two ends;

(B) a pair of essentially rectangular side panels, each integrally joined to one side of said bottom panel along a fold line and having opposed ends;

(C) a pair of essentially rectangular end panels, each integrally joined to one end of said bottom panel along a fold line and having opposed ends;

(D) a gore plate integrally joined to each end of said end panels along a fold line, said gore plate being sector-shaped with one linear edge along said fold line, the other linear edge adjacent to one end of one of said side panels, and the outer edge being arcuate;

(E) each end portion of each of said side panels having an arcuate guide groove in a wall portion therein between an inner surface and an outer surface of said wall portion for slidingly receiving the adjacent gore plate therewithin;

(F) an engaging piece projecting from the surface of one of said gore plate and said wall portion of the side panel having said guide groove, said engaging piece being bendable towards said surface; and (G) a hole in the surface of the other of said gore plate and said wall portion of the side panel having said guide groove to cooperate with and receive said engaging piece when the gore plate is fully received into said guide groove.

* * * * *